United States Patent [19]

Baslow

[11] Patent Number: 4,625,490

[45] Date of Patent: Dec. 2, 1986

[54] TRACKS FOR FABRIC WALL COVERINGS

[76] Inventor: Floyd M. Baslow, P.O. Box 778, Highland Lakes, N.J. 08422

[21] Appl. No.: 782,531

[22] Filed: Oct. 1, 1985

[51] Int. Cl.[4] ..... E04B 1/00

[52] U.S. Cl. ..... 52/716; 52/222; 52/273; 160/327; 160/392

[58] Field of Search ..... 52/222, 63, 716, 273; 160/395, 398, 392, 382

[56] References Cited

U.S. PATENT DOCUMENTS

| | | | |
|---|---|---|---|
| 3,408,250 | 10/1968 | Finefrock | 52/716 |
| 4,053,008 | 10/1977 | Baslow | 160/392 |
| 4,058,946 | 11/1977 | Habrant | 160/398 |
| 4,197,686 | 4/1980 | Baslow | 160/392 |
| 4,201,359 | 5/1980 | Baslow | 160/392 |

FOREIGN PATENT DOCUMENTS

| | | | |
|---|---|---|---|
| 1966057 | 8/1971 | Fed. Rep. of Germany | 52/222 |
| 2051914 | 2/1986 | United Kingdom | 52/222 |

*Primary Examiner*—Henry E. Raduazo
*Attorney, Agent, or Firm*—Michael Ebert

[57] ABSTRACT

A panel frame created by attaching molding pieces or tracks to a wall or other substrate to support a fabric panel whose margin has an excess tail that is anchored in the tracks. Each track is constituted by a plastic extrusion having a flat base that lies against the substrate and an overlying profiled strip having an edge wall joined to the base at right angles thereto along a line intermediate the upper and lower edges of the base, the section of the base below this line functioning as a mounting flange for the track. The strip further includes a raised flat face which is parallel to the base to define a storage channel therebetween, the face extending from the edge wall to a rounded cove terminating in a bent-in nose that normally abuts the upper border of the base to define a dilatable inlet leading into the storage channel. The cove is provided with a conforming layer of pressure-sensitive adhesive which initially serves to hold the margin of the fabric panel before the tail thereof is stuffed into the storage channel through the inlet, which initial holding action facilitates the proper orientation of the grain or pattern of the fabric panel relative to the track.

6 Claims, 10 Drawing Figures

Fig. 1.
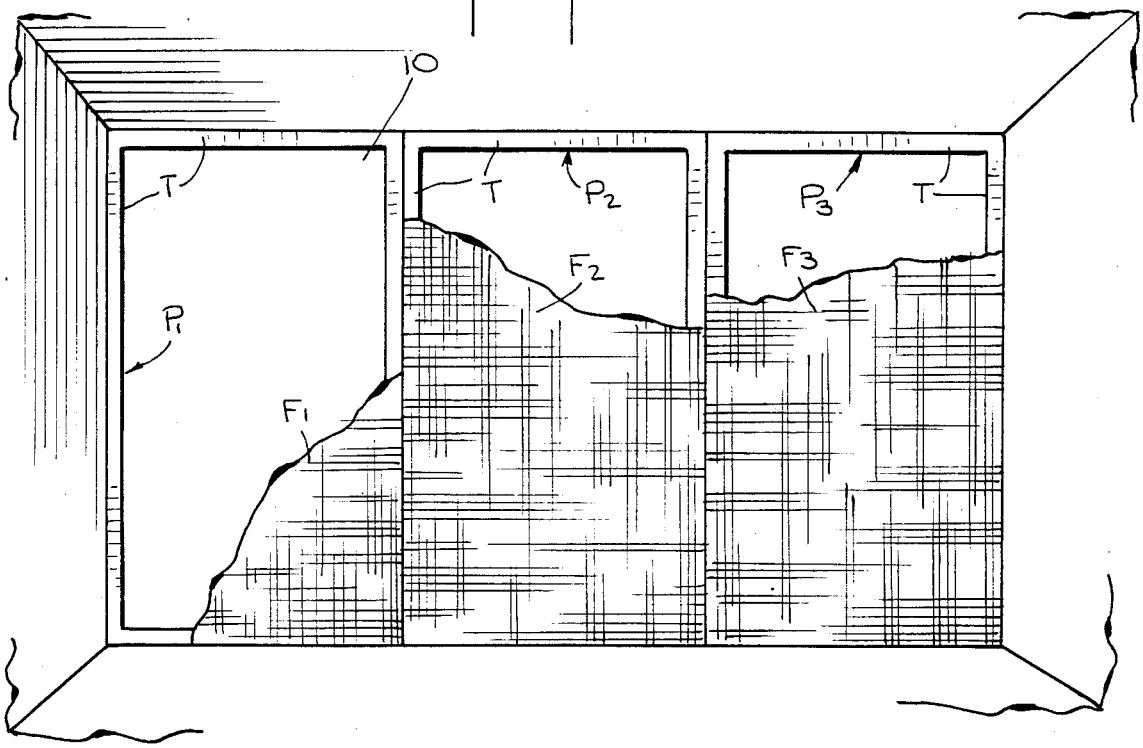
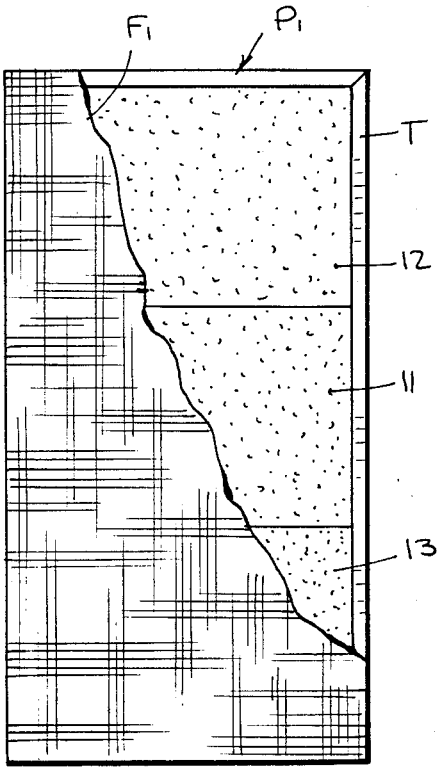
Fig. 2.
Fig. 3.
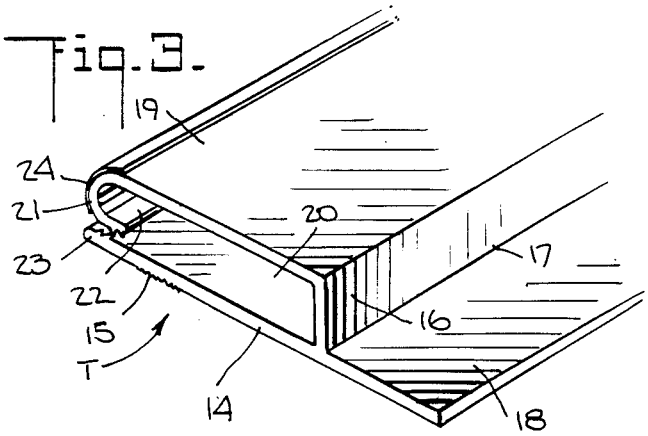
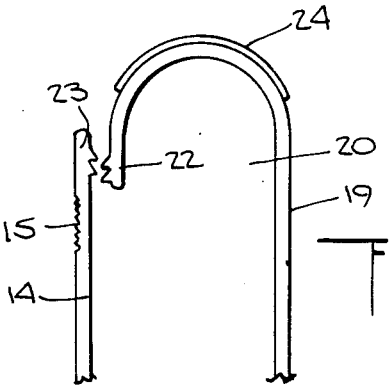
Fig. 6.

Fig. 4.
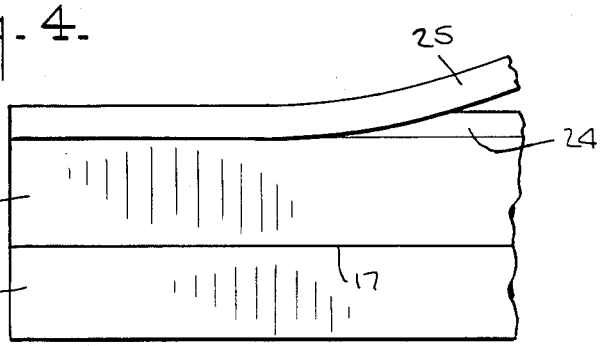
Fig. 5.
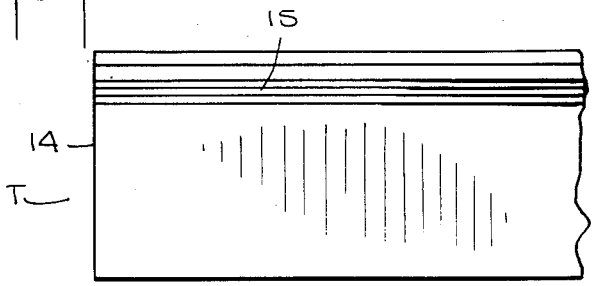
Fig. 9.
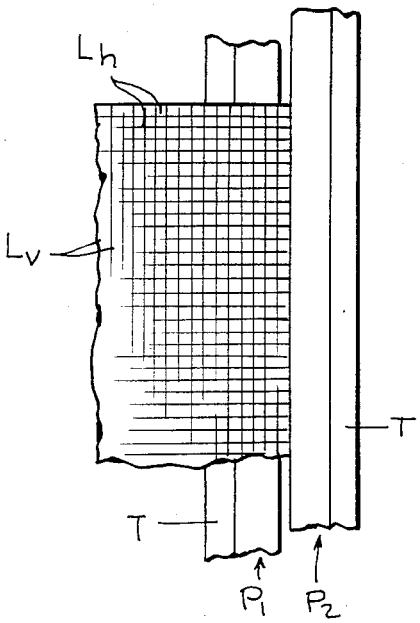
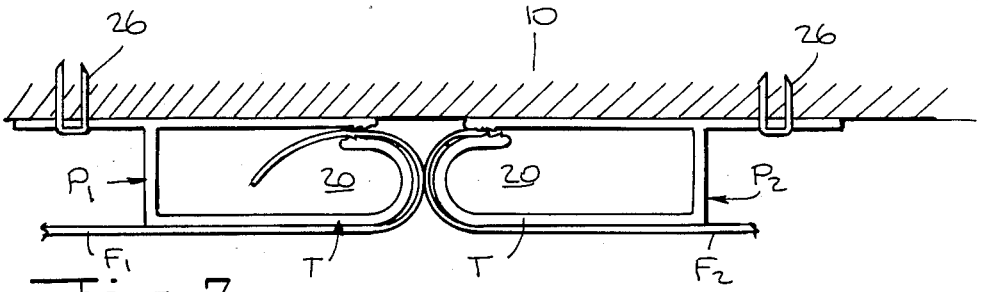
Fig. 7.
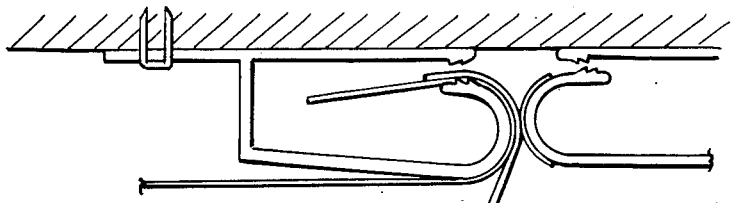
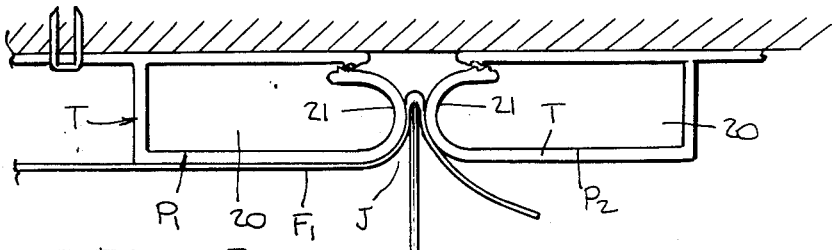
Fig. 8.
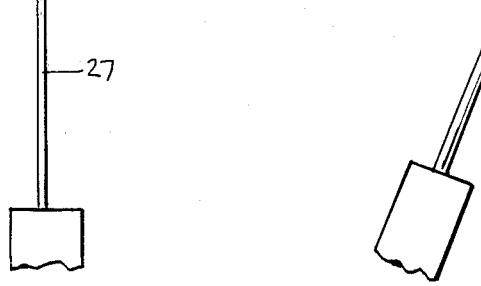
Fig. 10.

TRACKS FOR FABRIC WALL COVERINGS

BACKGROUND OF INVENTION

1. Field of Invention:

This invention relates generally to extruded molding pieces or tracks which are attachable to a wall or other substrate to create a frame thereon for supporting a fabric panel, and more particularly to improved tracks for this purpose which make it possible to so anchor the fabric that its grain or decorative pattern is properly oriented to provide a high quality installation.

2. Status of Prior Art:

In my prior U.S. Pat. Nos. (Baslow 4,197,686; 4,018,260; 4,053,008 and 4,157,762), there is disclosed an easily-installed fabric wall covering system in which a frame is attached to the wall upon which one can stretch a fabric sheet to provide a smooth, attractive wall covering. This system, which uses extruded molding pieces or tracks to create the frame, makes it possible to cover the walls in any room with luxurious or decorative fabrics which reflect the taste of the householder.

One may, for example, choose a wall covering fabric to match the drapery in the room, or its furniture or bedspreads, or for that matter any other distinctive element of the room decor. The system disclosed in these patents opens up a new world of decorating options, for it does away with the tedious, tricky and difficult procedures as well as the high level of professional skill heretofore required to overlay walls with fabric sheets.

The extruded molding piece or track basic to this fabric wall covering system is constituted by a storage channel having a generally rectangular cross-section. The flat front face of the channel has an adhesive layer thereon, the back or base of the channel being extended beyond its rear or lower end to define an installation flange which is attachable by staples or other means to the wall.

The front or upper end of the channel is provided with an inclined inlet defined by dilatable jaws of resilient material. These are normally closed, but are separable by a stuffing tool having a curved blade. After the tracks are assembled and attached to the wall to create a frame along the perimeter of the wall surface to be covered, the margins of the sheet are pressed against an adhesive layer on the face of the tracks and the excess tails of the sheet extending beyond these margins are stuffed by the tool through the inlets into the storage channels.

When the stuffing tool is withdrawn, the inlet jaws clamp on the fabric tail and thereby serve to securely anchor the covering sheet to the wall. Because the channels can accommodate either short or long excess tails, it is not necessary to cut the fabric sheet exactly to size as in prior systems, for the installer is afforded leeway in this regard, which gives him a wide latitude of acceptable error.

One practical difficulty with a track of the type disclosed in my prior patents is that the adhesive layer on the flat face of the track will in some instances lack sufficient holding power to retain the margin of the fabric sheet against the track while the tail extending beyond the margin is being stuffed into the storage channel.

In practice, the fabric sheet is tensioned or stretched to provide a smooth, taut surface. If, therefore, one anchors the upper end of a fabric sheet to an upper track attached to the top end of the wall, and now wishes to anchor the lower end of the fabric to a lower track attached to the bottom end of the wall, it is first necessary to stretch the fabric and then press the lower margin thereof against the adhesive layer on the face of this lower track. The fabric sheet is now under tension, and this gives rise to a shearing force that seeks to detach the margin of the fabric which is not yet anchored from the adhesive layer on the face of the lower track. Because the face of the track is parallel to the fabric margin, it offers little drag resistance to this shearing force, and the margin may detach itself from the adhesive layer on the face.

Another problem encountered with my prior tracks is that when these tracks are stapled by their mounting flanges to a wall, the storage channel section above the mounting flange which lies against the wall remains unattached thereto. When, therefore, a fabric is anchored in this storage channel and is subjected to heavy tension, the tension may, in some instances, be sufficient to flex the storage channel away from the wall and thereby render the installation unacceptable.

Also, with existing tracks in which an adhesive layer is coated on the face thereof, it is difficult when the fabric to be anchored thereon has a distinct grain, as in the case of a plaid pattern formed by intersecting horizontal and vertical lines, or in woven fabrics having distinct warp and woof lines, to properly orient the fabric on the track so that the grain is not angled with respect to the longitudinal track axis. The reason for this difficulty is that when the fabric margin is pressed against the adhesive flat face of the track preparatory to stuffing the tail into the storage channel, one cannot then, if the fabric pattern is not properly oriented, readily shift the position of the fabric.

SUMMARY OF INVENTION

In view of the foregoing, the main object of this invention is to overcome the problems encountered with prior art extruded molding pieces or tracks which are attachable to a wall or other substrate to create a frame panel for supporting a fabric covering panel, the invention providing a track whose configuration is such as to improve its holding characteristics.

More particularly, an object of this invention is to provide an extruded track in which the raised flat face of the track merges with a rounded cove which terminates in one jaw of a dilatable inlet leading into the storage channel, the cove having a conforming layer of pressure-sensitive adhesive thereon to hold the margin of the fabric, the rounded cove layer having a high coefficient of drag which resists the tendency of the fabric, when tensioned, to detach itself from the track.

Also an object of the invention is to provide an improved track which makes it possible to properly orient the grain or pattern of a fabric panel before the tail thereof is stuffed in the storage channel.

Briefly stated, these objects are attained in a panel frame created by attaching molding pieces or tracks to a wall or other substrate to support a fabric panel whose margin has an excess tail that is anchored in the tracks. Each track is constituted by a plastic extrusion having a flat base that lies against the wall and an overlying profiled strip having an edge wall joined to the base at right angles thereto along a line intermediate the upper and lower edges of the base, the section of the base below this line functioning as a mounting flange for the track.

The strip further includes a raised flat face which is parallel to the base to define a storage channel therebetween, the face extending from the edge wall to a rounded cove terminating in a bent-in nose that normally abuts the upper border of the base to define a dilatable inlet leading into the storage channel. The cove is provided with a conforming layer of pressure-sensitive adhesive which serves to hold the margin of the fabric panel before the tail thereof is stuffed into the storage channel through the inlet, which holding action facilitates the proper orientation of the grain or pattern of the fabric panel relative to the track.

OUTLINE OF DRAWINGS

For a better understanding of the invention as well as other objects and further features thereof, reference is made to the following detailed description to be read in conjunction with the accompanying drawings, wherein:

FIG. 1 illustrates a group of fabric-supporting panel frames attached to a wall, each panel frame being created by tracks in accordance with the invention;

FIG. 2 shows one panel frame and the backing boards therein behind the fabric panel;

FIG. 3 is a perspective view of the track as seen from one end;

FIG. 4 is a top view of the track;

FIG. 5 is a bottom view of the track;

FIG. 6 is an enlarged section of the cove portion of the track and the adhesive layer thereon;

FIG. 7 schematically shows a typical vertical or horizontal joint between parallel tracks on which fabric panels are supported;

FIG. 8 illustrates the relationship between the grain of the fabric and a track section;

FIG. 9 illustrates the manner in which a tool having a straight flat blade is used to orient the fabric pattern relative to the track; and FIG. 10 illustrates the manner in which a tool with a curved flat blade is used to stuff the tail of the fabric panel into the storage channel of the track.

DESCRIPTION OF INVENTION

The Fabric-Covering System:

Referring now to FIG. 1, there is shown the least complicated of a fabric covering system according to the invention, in which a wall 10 has a rectangular area which is not interrupted by a door, a window or any other discontinuity.

Most commercially-available fabrics come in standard widths, and in the case of large walls, it is necessary to use several panels of fabric to develop the necessary expanse. The actual dimensions of the fabric panels are not critical, for the excess or tails of the fabric panels are stuffed into the storage channels of the tracks. These tails need not be precisely dimensioned, for the channels can accommodate tails in a fairly broad range of sizes.

We shall assume that the dimensions of wall 10 are such that it takes three fabric panels $F_1$, $F_2$ and $F_3$ to cover this expanse. In order to support these fabric panels against the wall, three rectangular panel frames $P_1$, $P_2$ and $P_3$ are provided, each made up of track pieces T. The track pieces in each panel frame are miter-cut at the corners of the rectangle so that the tracks fit neatly together and there are no gaps in the panel frame. These track pieces are attached to the wall by staples and other bonding agents in a manner to be later described. These track pieces may be provided with pre-cut miters or may be miter cut in a miter box.

The fabric panels, such as fabric panel $F_1$, is so supported on panel frame $P_1$, as shown separately in FIG. 2, as to be separated from the wall or other substrate. By "other substrate" is meant a ceiling to which the frame is attached. The space between the fabric panel and the wall is used to provide acoustic or thermal insulation and for other useful purposes. Thus in the typical office installation, acoustic insulation is generally desirable in order to reduce the noise level.

On the other hand, it may be necessary in some office installations to provide a track area on the wall onto which one can, on occasion, tack papers and charts. To this end, attached to the wall at the midsection thereof is a tack board made of compressed fiber or other material capable of holding tacks which are inserted through the overlying fabric panel. And above and below tack board 11 to fill the wall area are acoustic boards 12 and 13 which are adapted to absorb sound. The boards are preferably all made of fire retardant material. Thus the midsection of the fabric panel may be used for tacking purposes; and since the tacks enter the interstices of the fabric, they do not mutilate this panel. In practice, the boards may be stapled or glued to the wall.

Where the panels are used to cover a ceiling, a door or other substrate, then the backing boards may be made entirely of acoustic material or made of standard acoustic tiles. Thus, in an installation in accordance with the invention, the walls and other substrates are not only covered with a decorative fabric to provide a more pleasing decor, but the backing boards serve to enhance the thermal or acoustic properties of the room or facility in which the installation is made.

The Track Pieces:

Referring now to FIGS. 3 to 6, each track piece T is a molding piece extruded of synthetic plastic material of good structural strength, such as PVC or ABS, the material having sufficient flexibility to provide a dilatable inlet.

Track T includes a flat base 14 whose outer surface, which lies against the wall, has formed therein adjacent its upper edge a band 15 of parallel striations. These act to provide a gripping surface for a bonding agent such as an epoxy or mastic to adhere the base to the wall or substrate.

Overlying base 14 is a profiled strip having an edge wall 16 joined at about right angles to base 14 along a straight line 17 intermediate the upper and lower edges of the base. The section of base 14 which lies below line 17 functions as a mounting flange 18 for the track. The strip further includes a raised flat face 19 which is parallel to base 14 to define therewith an interior cavity functioning as a storage channel 20.

Face 19, whose lower edge is joined to the top of edge wall 16, extends to and merges with a rounded cove 21 terminating in a bent-in nose 22. Nose 22 normally abuts the upper border 23 of base 14 to define therewith the jaws of a dilatable inlet leading into storage channel 20. The complementary surface of these jaws preferably have gripping teeth formed therein.

As best seen in FIG. 6, cove 21 is provided with a conforming layer 24 formed by a double faced tape of pressure-sensitive adhesive which also overlies the junction between the cove and flat face 19 of the track. This curved adhesive layer is normally covered by a protective release tape 25, preferably made of a flexible film capable of conforming to the curvature of the layer. After the track is attached to the wall, tape 25 is peeled off the layer so that the margin of the fabric to be anchored by the track can be adhered thereto.

Installation:

Track T is secured to the wall surface by the combined action of the striated band 15 which is bonded to the wall and the mounting flange 18 which is stapled or otherwise pinned to the wall. Just prior to installation, striated band 15 on the rear surface of base 14 is coated with a curable bonding agent appropriate to the composition of the substrate. Hence, the nature of this agent may be different for a plaster wall than for a concrete or tiled wall. Then the coated track is pressed against the wall and the bonding agent proceeds to cure. In practice, a stapling gun may be used to drive heavy duty staples through the mounting flange into the substrate.

This combination of holding expedients acts to secure both the storage channel and the mounting flange to the wall so that the storage channel cannot be flexed away from the wall even when the fabric anchored therein subjects the channel to heavy stresses. The attachment is of high strength, even on irregular walls which create gaps between the track and wall; for while the bonding agent will be ineffective in the gaps, it will hold wherever there is contact between the track base and wall, and the staples or other mechanical expedients used with the mounting flange will hold wherever they are placed.

Referring now to FIG. 7, the joint between the adjacent tracts T of frame panels $P_1$ and $P_2$ is shown, these tracks being pinned to wall 10 by staples 26. It will be seen that the tail of fabric panel $F_1$ is held within the storage channel 20 of frame $P_1$ track and that the tail of fabric panel $F_2$ is held within the storage channel 20 of the frame $P_2$ track. Between these fabric panels and the wall 10 acoustic insulation boards may be placed, these not being shown in this figure.

In order to allow for the insertion of the tails into the storage channels of the adjacent frame panel tracks, these tracks are spaced slightly apart to an extent determined by the thickness of the fabric. Thus a greater spacing is required for heavier fabrics.

Referring now to FIG. 9, the relationship of fabric panel $F_1$ to track T of frame panel $P_1$ is illustrated. It will be seen that the fabric panel has a uniform grain represented by horizontal lines $L_h$ and vertical lines $L_v$, and for proper orientation of the fabric, the vertical lines must be parallel to the longitudinal axis of tracks T.

In order to insure proper orientation, use is made of a tool 27, as shown in FIG. 8, having a straight flat blade similar to that of a putty knife. In order to anchor the margin of fabric $F_1$ in track T of frame panel $P_1$, one first removes the release film 25 covering the adhesive tape on the rounded cove of the track of panel frame $P_1$, the release paper on the adhesive tape on the cove of the adjacent track remaining in place. One then lays the margin of fabric panel $F_1$ over the junction J between the adjacent tracks and with the flat blade of tool 27, one forces the margin into this junction so that it adheres to the adhesive tape on the track cove 21 of panel frame $P_1$, but does not adhere to the tape on the adjacent track cove of panel frame $P_2$ which is still covered.

The fabric margin now adheres to the exposed adhesive tape on the cove of panel frame $F_1$ and one can now examine the orientation of the fabric relative to the track to see whether it is proper. If it is not proper, the fabric margin is pulled out of the junction, the fabric is repositioned and the tool procedure is repeated until the orientation is proper.

Now the fabric is ready for stuffing into the storage channel 20 of the track of panel frame $P_1$ and for this purpose use is made of a stuffing tool 28, as shown in FIG. 10, having a curved blade which makes it possible to go under the cove of the track and lift the cove to dilate the inlet to the storage channel 20 and to force the tail of the margin therein, at which point the stuffing tool is removed to release the cove and cause the inlet jaws to clamp on the fabric margin. Thus the fabric is now held both by the jaws and by the adhesive tape.

The same procedure is repeated for the orientation of the fabric panel $F_2$ with respect to the track of frame panel $P_2$ and then stuffing the tail of this fabric into the storage channel.

The fact that it is the rounded cove of the track which is provided with a tape of adhesive material and not the flat face thereof as in my prior patents, is a significant feature of the invention. When a tensioning force is imposed on the fabric panel, this force produces a vector component which acts to press the margin of the fabric against the rounded cove. The cove is at an angle to the tensioning force and thereby increases the coefficient of drag of the fabric margin.

Hence, while the tensioning force would tend to shear the margin of the fabric from the face of the track had the face been coated with adhesive, it does not act in this manner in respect to the cove, for the tensioning force serves to enhance the adhesive bond of the margin to the cove.

While there has been shown and described a preferred embodiment of TRACKS FOR FABRIC WALL COVERING in accordance with the invention, it will be appreciated that many changes and modifications may be made therein without, however, departing from the essential spirit thereof. Thus when covering large walls, the necessary expanse of fabric may be created by seaming together in side-by-side relation fabrics of standard width.

I claim:

1. A panel frame formed by track pieces attachable to a wall for supporting a fabric panel whose margin has an excess tail that is anchored in the track pieces, each track piece comprising:

(A) A flat base that lies against the wall, said base having parallel upper and lower edges, the rear surface of said base adjacent its upper edge having a band of striations thereon to facilitate bonding thereof to said wall;

(B) a profiled strip that overlies the base and has an edge wall joined to the base at about a right angle thereto along a line intermediate the upper and lower edges of the base, the section of the base below said line functioning as a mounting flange for the track piece to secure it to the wall, a raised face parallel to the base to define therewith a storage channel, said face being adhesive-free and extending from the edge wall to a rounded cove terminating in a bent-in nose that normally abuts the upper border of the base to define a dilatable inlet leading into said storage channel; and (C) a layer of pressure-sensitive adhesive provided on said cove to hold the margin of the fabric panel as the tail thereof is being stuffed into said channel through the inlet.

2. A panel frame as set forth in claim 1, wherein said track is formed by an extruded synthetic plastic material having sufficient flexibility to provide said dilatable inlet.

3. A panel frame as set forth in claim 1, wherein the complementary surfaces of said nose and said border are provided with gripping teeth.

4. A panel frame as set forth in claim 1 wherein said layer is formed of double-face adhesive tape.

5. A panel frame as set forth in claim 4, further including a peel-off release film protectively covering said adhesive tape.

6. A track as set forth in claim 2 wherein said material is polyvinylchloride.

* * * * *